US005183410A

United States Patent [19]

Inaba et al.

[11] Patent Number: 5,183,410

[45] Date of Patent: Feb. 2, 1993

[54] CONNECTOR ASSEMBLY

[75] Inventors: Shigemitsu Inaba; Mitsuhiro Matsumoto, both of Shizuoka, Japan

[73] Assignee: Yazaki Corporation, Tokyo, Japan

[21] Appl. No.: 858,846

[22] Filed: Mar. 27, 1992

[30] Foreign Application Priority Data

Apr. 1, 1991 [JP] Japan ..... 3-068212

[51] Int. Cl.[5] ..... H01R 3/00

[52] U.S. Cl. ..... 439/489; 439/354

[58] Field of Search ..... 439/345, 350, 353, 354, 439/357, 488, 489

[56] References Cited

U.S. PATENT DOCUMENTS 4,993,967 2/1991 Matsumoto ..... 439/352 X 5,041,017 8/1991 Nakazato et al. ..... 439/352 X

FOREIGN PATENT DOCUMENTS 61-99381 6/1986 Japan .

*Primary Examiner*—Neil Abrams

*Assistant Examiner*—Khiem Nguyen

*Attorney, Agent, or Firm*—Sughrue, Mion, Zinn, Macpeak & Seas

[57] ABSTRACT

A connector assembly including a pair of connector housing in which the force of repulsion of a spring which is provided to prevent the incomplete engagement of the connector housings is eliminated when the connector housings are locked to each other. The connector assembly includes a male connector housing (B) including a movable striking member (C) and a female connector housing (A) with a flexible lock arm (10). When the flexible lock arm (10) is elastically displaced during the engagement of the locking protrusion (10*b*) of the male connector housing and the engaging portion (12) of the female connector housing, the disengaging protrusion (10*c*) of the flexible lock arm (10) disengages the engaging portion (7) of the movable striking member (C) from the receiver (11) of the male connector housing (B), whereupon the elastic force of the compression coil spring (5) is eliminated to cause the striking flange (6) of the movable striking member (C) to strike against the partition wall (2) of the female connector housing, so that an inertial force is applied to the female connector housing (B) to allow the latter to engage with the male connector housing.

12 Claims, 8 Drawing Sheets

CONNECTOR ASSEMBLY

BACKGROUND OF THE INVENTION

1. Field of the Invention

This invention relates to a connector assembly used for connecting wire harnesses in automobiles.

2. Background

Referring to in FIG. 21, reference character a designates a female connector housing, and b a male connector housing. The female connector housing and the male connector housing b incorporate metal terminals c and d, respectively. The female connector housing a has a flexible lock arm e. When the male and female connector housings are engaged with each other, the flexible lock arm e is engaged with a locking portion f of the male connector housing.

A compression spring g is interposed between the male and female connector housings b and a, to exert a forcing urging them away from each other when they are engaged with each other.

In the connector assembly thus constructed, when the male and female connector housings b and are engaged with each other, the spring g is compressed. During incomplete engagement of the male and female connector housings, (i.e., when the lock arm e is not locked to the locking portion f although the male and female connector housings are engaged with each other) the compression spring g moves the male and female connector housings b and a away from each other, thereby preventing their incomplete engagement.

FIG. 22 shows the male and female connector housings b and a which have been completely engaged with each other with the lock arm e engaged with the locking portion f.

In the above-described conventional connector assembly, when the male and female connector housings b and a have been completely engaged with each other as shown in FIG. 22, the resiliency (force of repulsion) of the compression spring acts on the male and female connector housings b and a continuously, thus hampering the stable contact of the metal terminals c and d.

In view of the foregoing, an object of this invention is to provide a connector assembly comprising a pair of connector housings in which the force of repulsion of a spring which is provided to prevent the incomplete engagement of the connector housings is eliminated when the connector housings are locked to each other.

SUMMERY OF THE INVENTION

The foregoing object of the invention has been achieved by the provision of a connector assembly which, according to the invention, comprises a first connector housing in which a movable striking member is provided in such a manner that the movable striking member is movable back and forth, and in which a spring is interposed between the movable striking member and the first connector housing; and a second connector housing having a receiver to drive the movable striking member against the elastic force of the spring when engaged with the first connector housing, and, in which during engagement of locking mechanisms provided for the first and second connector housings, the engagement of the movable striking member in the first connector housing and the receiver of the second connector housing is eliminated to cause the movable striking member to strike against the first connector housing in a direction of engagement.

More specifically, in the connector assembly, while the first and second connector housings are pushed towards each other, the movable striking member in the first connector housing is engaged with the receiver of the second connector housing so that it is moved backwardly against the elastic force of the spring. During the engagement of the first and second connector housings, the engagement of the movable striking member with the receiver is eliminated, so that the movable striking member is moved forwardly by the spring to strike against the first connector housing.

DETAILED DESCRIPTION OF THE INVENTION

An example of a connector assembly, which constitutes a first embodiment of the invention, will be described with reference to FIGS. 1 through 7.

Figure 1:
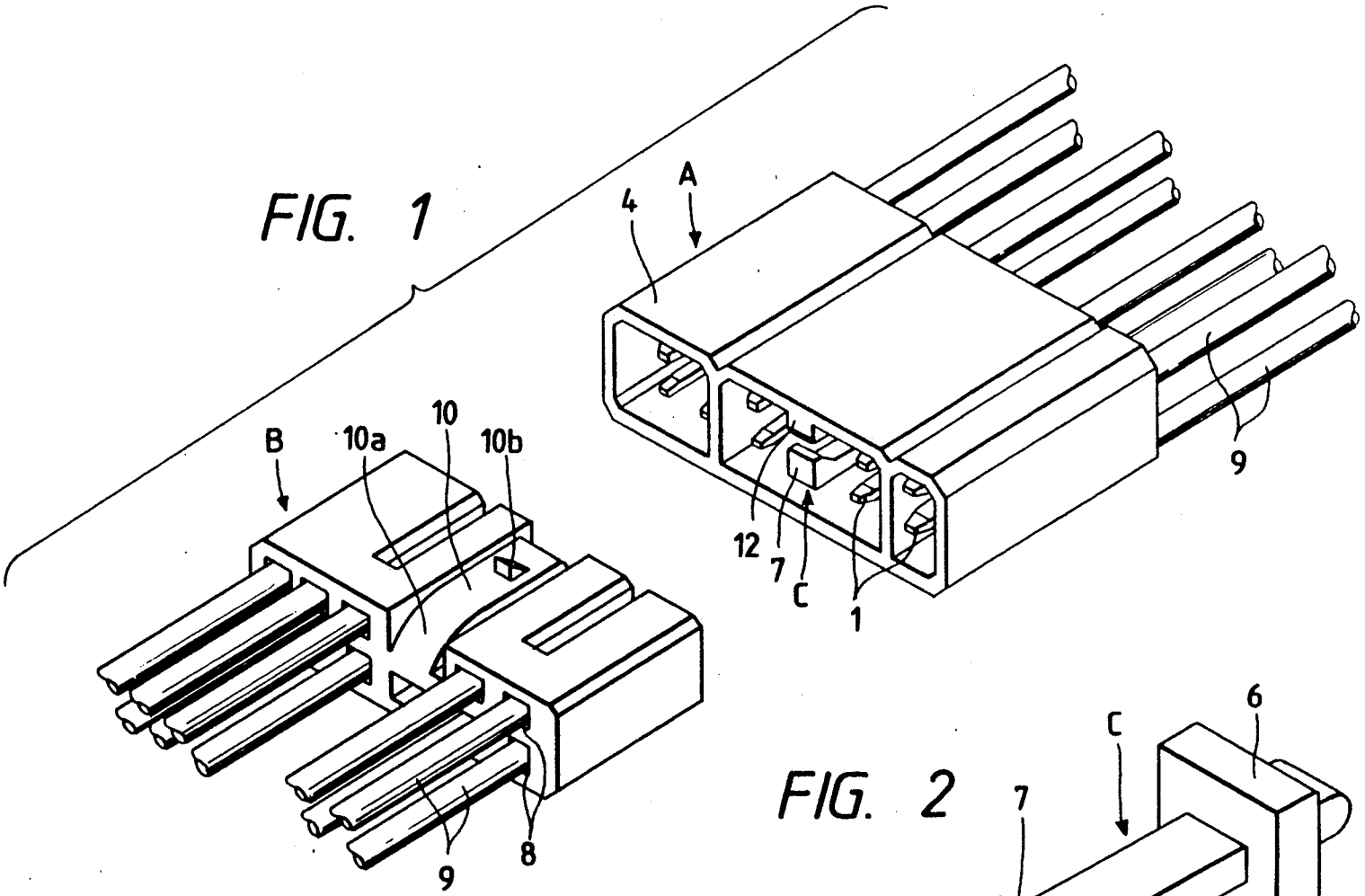
FIG. 1 is a perspective view of an example of a connector assembly, according to a first embodiment of this invention, showing a pair of connector housings which are not yet engaged with each other.

Referring to FIG. 1, reference character A designates a female connector housing; B, a male connector housing; and C, a bar-shaped movable striking member which is accommodated in the female connector housing A in such a manner that it is movable back and forth therein.

Figure 2:
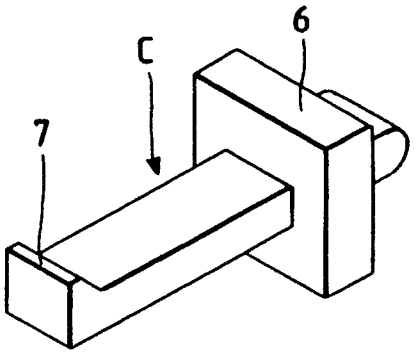
FIG. 2 is a perspective view showing a movable striking member in the connector assembly shown in FIG. 1.
Figure 3:
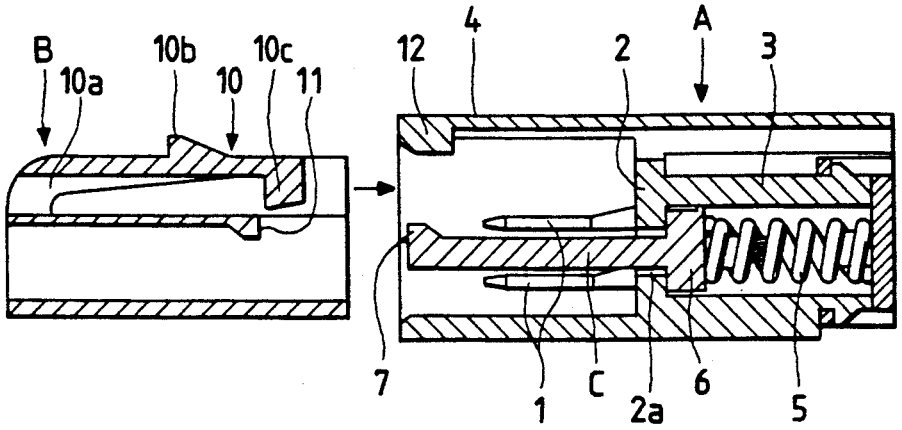
FIG. 3 is a sectional view of the pair of connector housings disengaged from each other.

As shown in FIGS. 1 through 3, in the female connector housing A, a plurality of male metal terminals 1 are secured in terminal accommodating chambers (not shown), and the movable striking member C extends through a hole 2*a* formed in a partition wall 2 so that it is supported by the partition wall 2; that is, the movable striking member C extends from spring housing 3 into frame 4, as shown in FIG. 3. In the spring housing 3, a compression spring 5 is abutted against a striking flange 6 of the movable striking member C, the flange 6 also acting as a spring seat. The front end portion of the movable striking member C is formed into an engaging portion 7 extending upwardly.

The male connector housing B includes terminal accommodating chambers 8 in which female metal terminals (not shown) connected to wires 9 are accommodated.

A flexible lock arm 10 is formed on the top of the male connector housing B. The flexible lock arm 10 has a base 10*a* at the rear end thereof, a disengaging protrusion 10*c* at the front end thereof which extends inwardly, and a locking protrusion 10*b* between the base 10*a* and the disengaging protrusion 10*c*. Further, a receiver 11 is provided for receiving the movable striking member C (as will be described below), which forms a part of the walls forming the male connector housing B.

Figure 4:
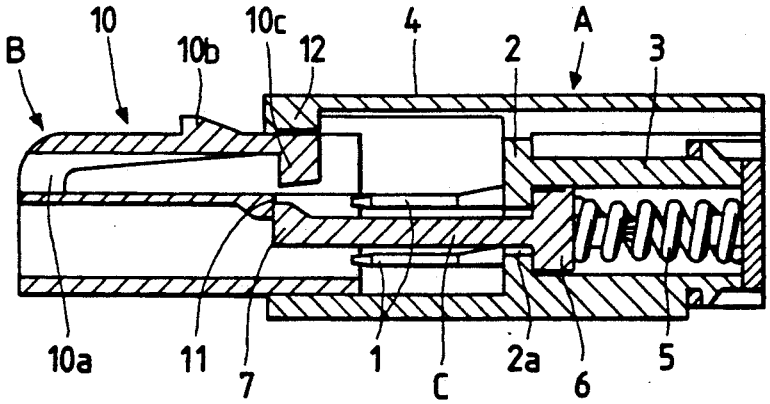
FIG. 4 is a sectional view showing the pair of connector housings in the stage of being engaged with each other.
Figure 5:
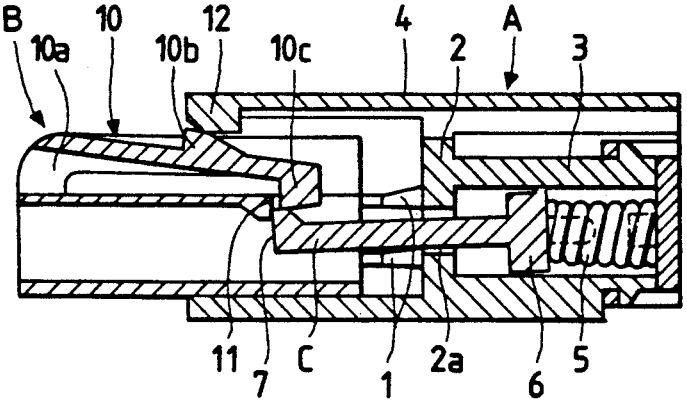
FIG. 5 is a sectional view showing the pair of connector housings in the stage of being engaged with each other.

When the female connector housing A and the male connector housing B (which have been separated from each other as shown in FIG. 3) are engaged with each other, the engaging portion 7 of the movable striking member C strikes against the receiver 11 located below the disengaging protrusion 10*c* in the male connector housing B, so that the movable striking member C is moved backwardly against the elastic force of the compression spring 5, as shown in FIGS. 4 and 5.

Figure 6:
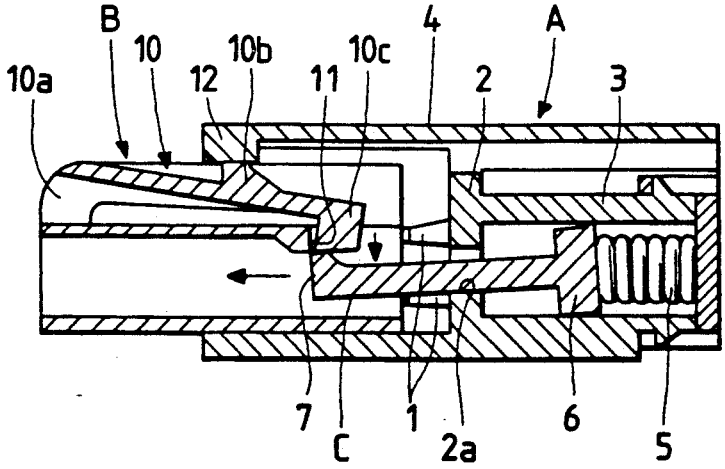
FIG. 6 is a sectional view showing the pair of connector housings in the stage being locked to each other.

When, under this condition, the male and female connector housings are further pushed towards each other, the movable striking member C increases the force of repulsion of the compression spring, while the locking protrusion 10*b* of the flexible lock arm 10 engages with the engaging portion 12 which protrudes inwardly from the front edge of the frame 4 of the female connector housing A. As a result, the flexible lock arm 10 is displaced inwardly, and the disengaging protrusion 10*c* thereof engages with the engaging portion 7 of the movable striking member C to displace the striking member C so that the engaging portion 7 is disengaged from the receiver 11 (as shown in FIG. 6), while the movable striking member C further increases the force of repulsion of the compression coil 5. Hence, when, under this condition, the male and female connector housings are set free, the female connector housing A and the male connector housing B are separated from each other since the spring force is greater than the slide resistance of the housings A and B.

Figure 7:
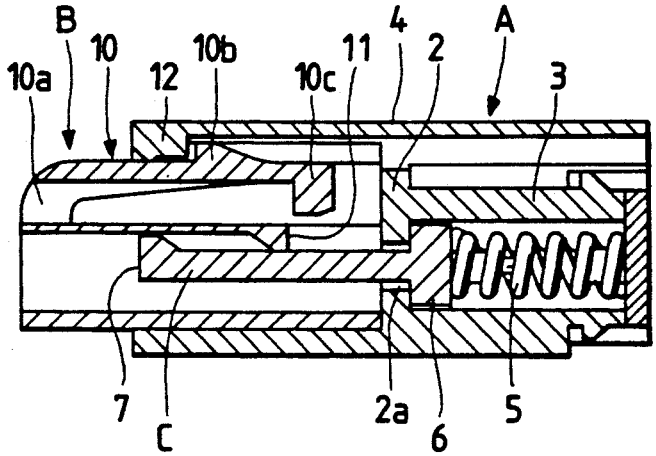
FIG. 7 is a sectional view showing the pair of connector housings in the locked state.
Figure 8:
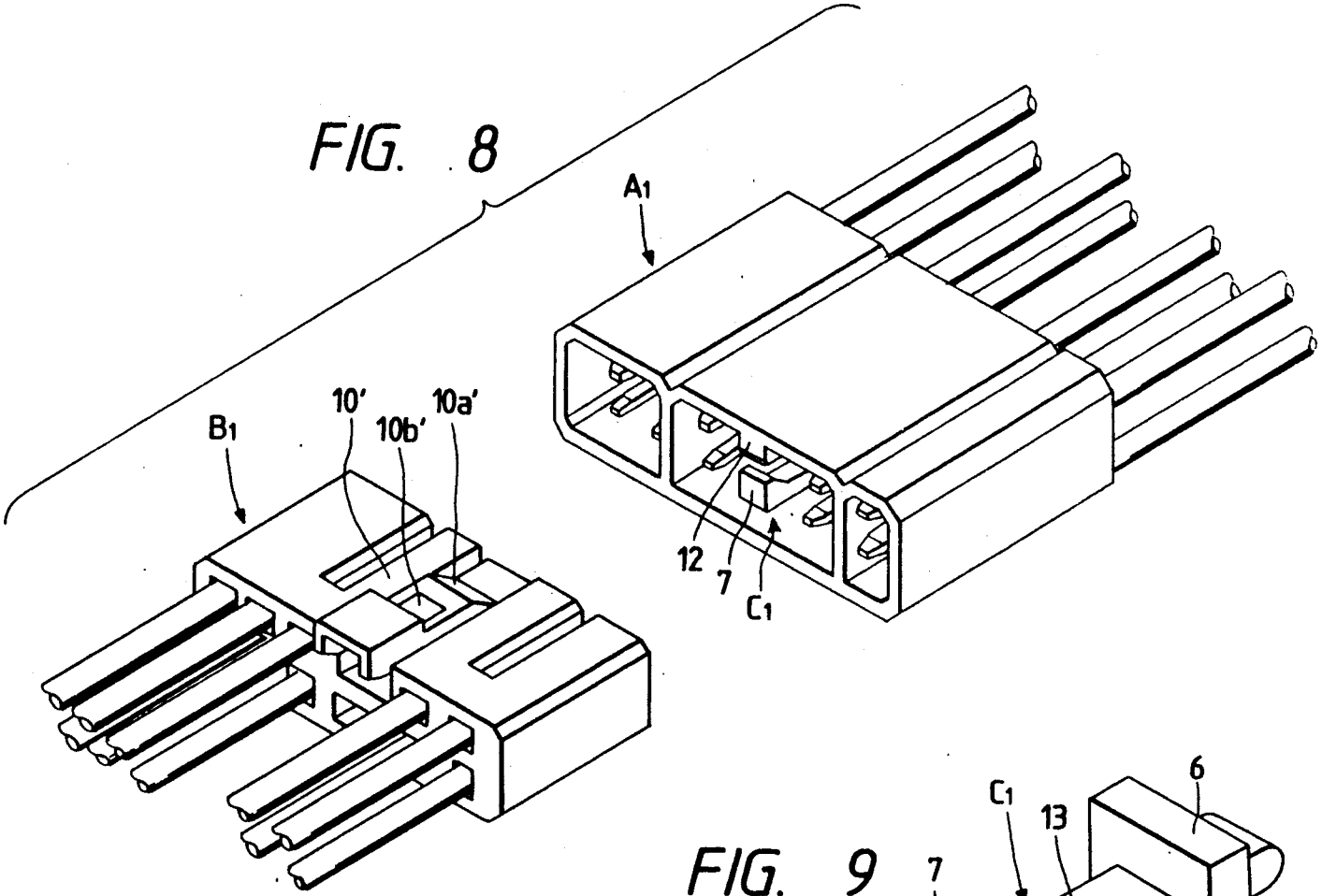
FIG. 8 is a perspective view of another example of the connector assembly, according to a second embodiment of the invention, showing a pair of connector housings which are disengaged from each other.
Figure 9:
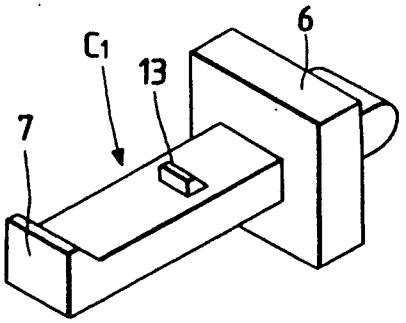
FIG. 9 is a perspective view showing a movable striking member in the connector assembly shown in FIG. 8.
Figure 10:
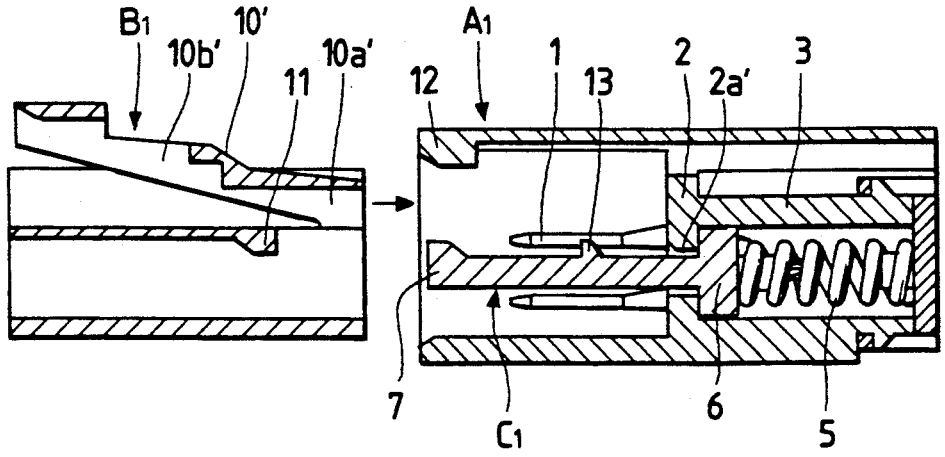
FIG. 10 is a sectional view showing the pair of connector housings in the connector assembly shown in FIG. 8 which are disengaged from each other.

When the flexible lock arm 10 is elastically displaced the maximum amount during the engagement of the locking protrusion 10*b* and the engaging portion 12, the disengaging protrusion 10*c* disengages the engaging portion 7 of the movable striking member C from the receiver 11 of the male connector housing B. At this moment, the elastic force of the compression spring 5 is released causing the striking flange 6 of the movable striking member C to strike against the partition wall 2, so that an inertial force is applied to the female connector housing B to allow the latter to completely engage the male connector housing. Due to the inertial force, the operator can push the connector housings A and B towards each other with ease. In this operation, the locking protrusion 10*b* of the flexible lock arm 10 engages the engaging portion 12 with a snap-like action, as shown in FIG. 7.

FIGS. 8 through 14 illustrate another example of the connector assembly, which constitutes a second embodiment of the invention.

In the connector assembly of the second embodiment, a male connector housing $B_1$ comprises a flexible lock arm 10′ which has a base 10*a*′ at the front end, and an engaging slot 10*b*′ at the mid portion, while a female connector housing $A_1$ comprises a bar-shaped striking member $C_1$ having a disengaging protrusion 13 at the mid portion.

Figure 11:
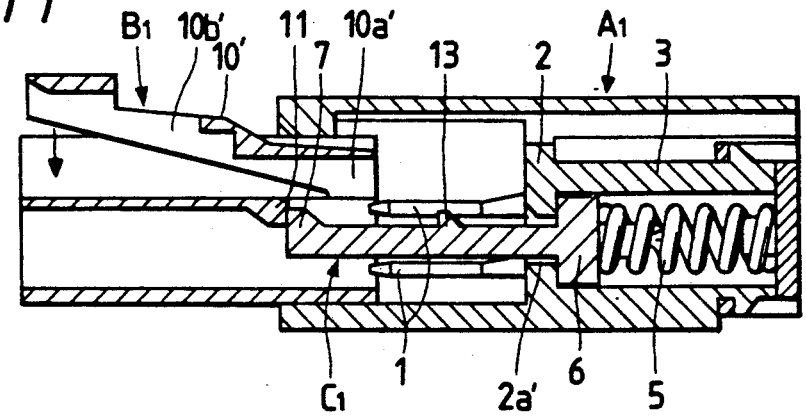
FIG. 11 is a sectional view showing the pair of connector housings in the connector assembly shown in FIG. 8 in the stage of being engaged with each other.
Figure 12:
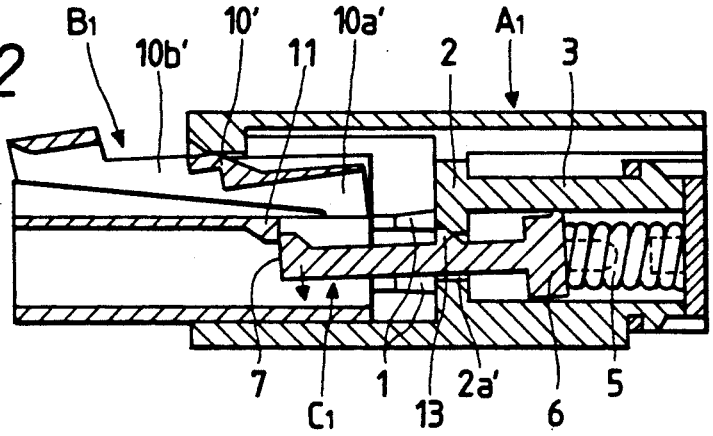
FIG. 12 is a sectional view showing the pair of connector housings in the connector assembly shown in FIG. 8 in the stage of being engaged with each other.
Figure 13:
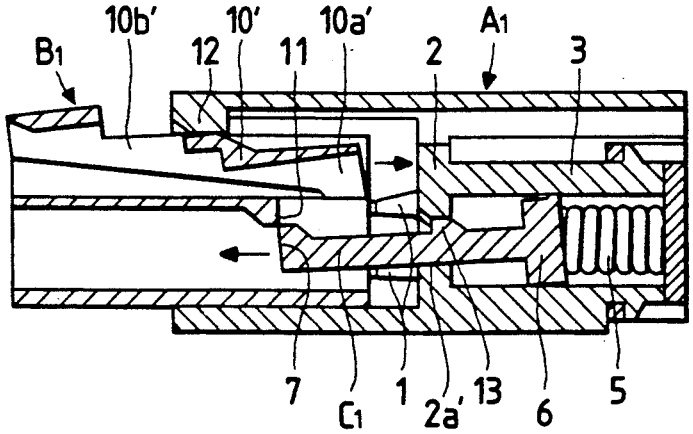
FIG. 13 is a sectional view showing the pair of connector housings in the connector assembly shown in FIG. 8 in the stage of being locked to each other.
Figure 14:
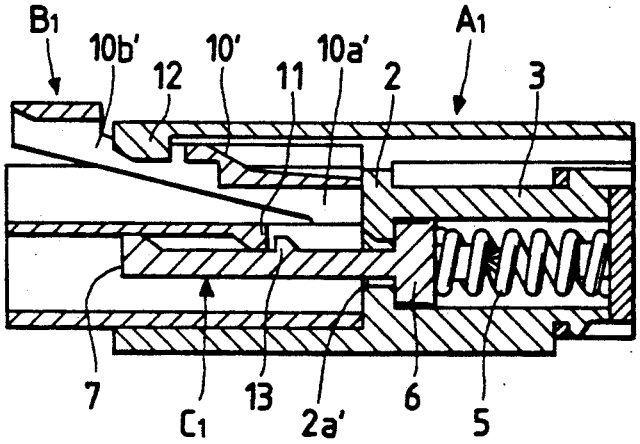
FIG. 14 is a sectional view showing the pair of connector housings in the connector assembly shown in FIG. 8 in the locked state.
Figure 15:
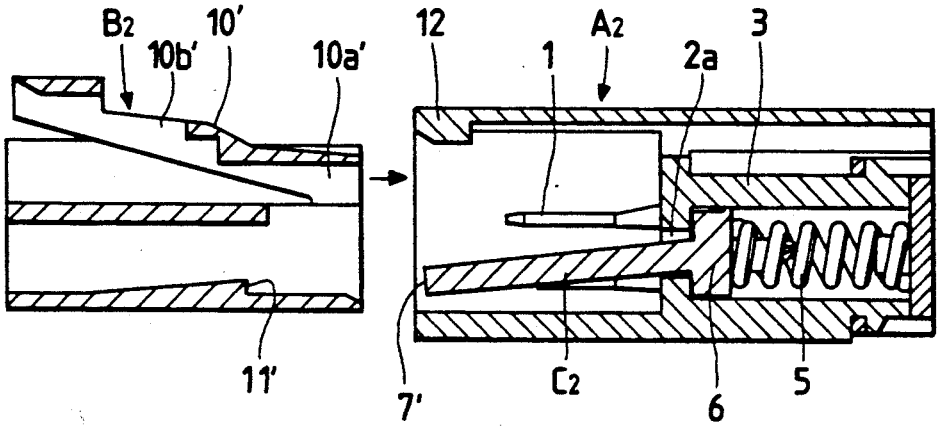
FIG. 15 is a perspective view of the connector assembly, according to a third embodiment of the invention, showing a pair of connector housings which are disengaged from each other.

As the female connector housing $A_1$ and the male connector housing $B_1$ are pushed towards each other, the movable striking member $C_1$ is moved backwardly against the elastic force of the compression coil spring 5, similar to the first embodiment, as illustrated in FIGS. 11 and 12. As the connector housings are further pushed towards each other, the disengaging protrusion 13 of the movable striking member $C_1$ is brought into contact with the inner wall of the hole 2*a*′ so that the movable striking member $C_1$ is displaced downwardly to disengage the engaging portion 7 from the receiver 11 as shown in FIGS. 12 and 13. As a result, the striking flange 6 of the movable striking member is caused to strike against the partition wall 2, while the engaging slot 10*b*′ of the flexible lock arm 10′ is engaged with the engaging portion 12, as shown in FIG. 14.

FIGS. 15 through 19 show another example of the connector assembly, which constitutes a third embodiment of the invention.

In the third embodiment, the female connector housing $A_2$ includes a bar-shaped movable striking member $C_2$ which is so formed that the engaging portion 7′ at the front end is disposed below the direction of engagement of the connector; that is, the body of the movable striking member is obliquely downwardly extended with respect to the direction of engagement of the connector.

The male connector housing $B_2$ has a receiver 11' on the bottom portion thereof for receiving the engaging portion 7'.

Figure 16:
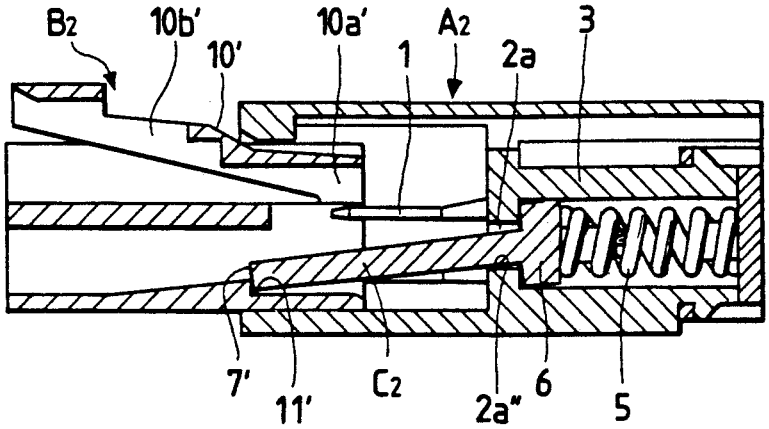
FIG. 16 is a sectional view showing the pair of connector housings in the connector assembly shown in FIG. 15 in the stage of being engaged with each other.
Figure 17:
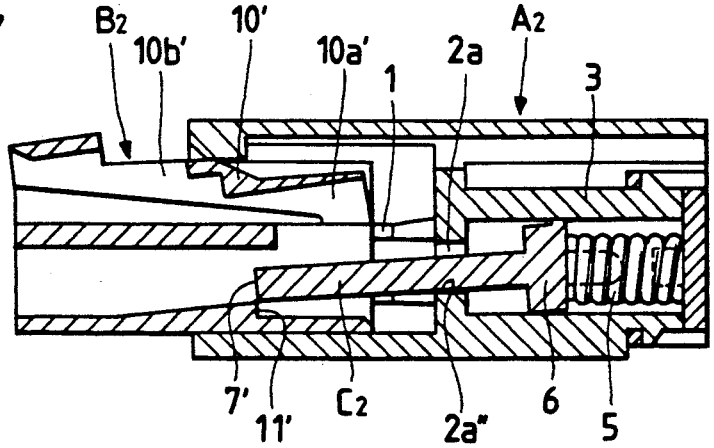
FIG. 17 is a sectional view showing the pair of connector housings in the connector assembly shown in FIG. 15 in a further stage of being engaged with each other.
Figure 18:
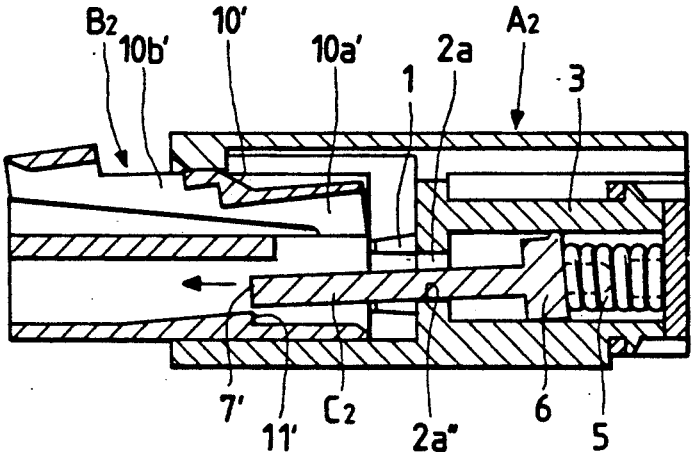
FIG. 18 is a sectional view showing the pair of connector housings in the connector assembly shown in FIG. 15 in the stage of being locked to each other.
Figure 19:
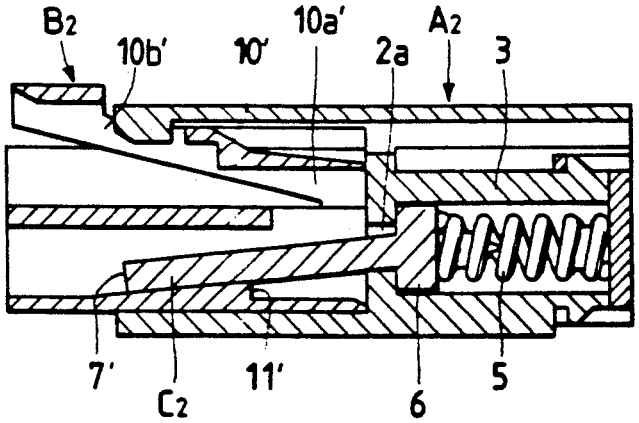
FIG. 19 is a sectional view showing the pair of connector housings in the connector assembly shown in FIG. 15 in the locked state.

As the female connector housing $A_2$ and the male connector housing $B_2$ are pushed towards each other, the engaging portion 7' of the movable striking member $C_2$ abuts against the receiver 11' as shown in FIG. 16. As the connector housings are further pushed towards each other, the movable striking member $C_2$ is moved backwardly (to the right in the figures) so that its engaging portion is raised by the edge 2a'' of the hole 2a formed in the partition wall, as shown in FIGS. 17 and 18. When the connector housings are further pushed towards each other, the movable striking member $C_2$ is further raised so that the engaging portion 7' is disengaged from the receiver 11', as shown in FIG. 19.

Figure 20:
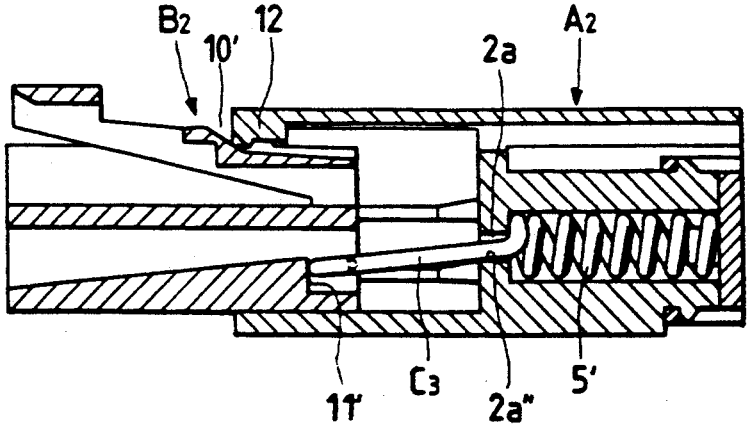
FIG. 20 is a sectional view of the connector assembly, according to a fourth embodiment of the invention, showing a pair of connector housings which are disengaged from each other.
Figure 21:
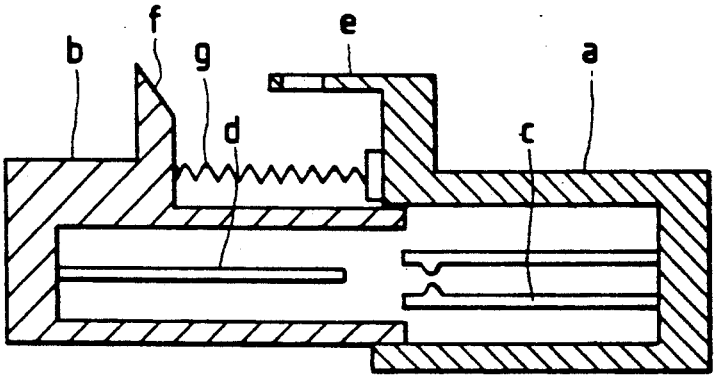
FIG. 21 PRIOR ART
FIG. 21 is a sectional view of a conventional connector assembly comprising a pair of connector housings.
Figure 22:
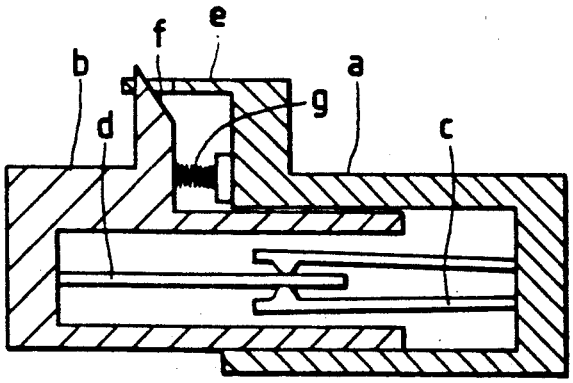
FIG. 22 PRIOR ART
FIG. 22 is a sectional view showing the pair of connector housings in the conventional connector assembly which have been engaged with each other.

FIG. 20 shows another example of the connector assembly, which constitutes a fourth embodiment of the invention. In the fourth embodiment, a bar-shaped movable striking member $C_3$ is integral with a compression coil spring 5'. More specifically, the striking member is extended obliquely from the end of the spring 5'.

As was described above, the connector assembly of the invention includes the first connector housing (female connector housing) in which the movable striking member is provided in such a manner that it is movable back and forth, and the spring is interposed between the movable striking member and the first connector housing; and the second connector housing (male connector housing) having the receiver to drive the movable striking member against the elastic force of the spring when engaged with the first connector housing. During engagement of the locking mechanisms provided for the first and second connector housings, the engagement of the movable striking member in the first connector housing and the receiver of the second connector housing is eliminated to cause the movable striking member to strike against the first connector housing in a direction of engagement. In locking the male and female connector housings, the force of repulsion of the spring for preventing the incomplete engagement of the connector housings is eliminated, so that the metal terminals can be connected to one another with a high degree of stability. Furthermore, during the engagement of the male and female connector housings, the movable striking member strikes against the female connector housing, thus decreasing the force required for manually connecting the connector housings together, with the result that the engagement of the male and female connector housings can be easily achieved.

WHAT IS CLAIMED IS:

1. A connector assembly, comprising:

a first connector housing including a striking member slidably disposed therein and having one end extending in a first direction, and a spring interposed between said movable striking member and a portion of said first connector housing for urging said striking member in said first direction; and a second connector housing including a receiver for receiving said one end of said striking member such that said striking member is forced in a second direction, opposite said first direction, upon insertion of one of said connector housings into the other of said connector housings to compress said spring, wherein during engagement of said first and second connector housings, said striking member is disengaged from said receiver to cause said striking member to strike against said first connector housing forcing said first connector housing in said first direction.

2. The connector assembly of claim 1, further comprising a locking mechanism for locking said first and second connector housing to one another upon final engagement thereof.

3. The connector assembly of claim 1, wherein said striking member is integral to said spring.

4. A connector assembly, comprising:

a first connector housing including a striking member slidably disposed therein and having one end extending in a first direction, and a spring interposed between said movable striking member and a portion of said first connector housing for urging said striking member in said first direction;

a second connector housing including a receiver for receiving said one end of said striking member such that said striking member is forced in a second direction, opposite said first direction, upon insertion of one of said connector housings into the other of said connector housings to compress said spring; and means for disengaging said one end of said striking member from said receiver during engagement of said connector housings to each other such that said striking member strikes against said first connector housing forcing said first connector housing in said first direction.

5. The connector assembly of claim 4, further comprising a flexible locking arm provided on said second connector housing and an engaging portion provided on said first connector housing, said locking arm engaging said engaging portion for locking said connector housings to one another.

6. The connector assembly of claim 5, wherein said disengaging means is provided on said locking arm.

7. The connector assembly of claim 4, wherein said striking member is slidably disposed in a hole provided in said first connector housing.

8. The connector assembly of claim 7, wherein said disengaging means includes a projection extending radially outwardly from said striking member and positioned in said first direction with respect to said hole, said striking member disengaging from said receiver when said projection contacts a side wall of said hole as said striking member is moved in said second direction.

9. The connector assembly of claim 8, further comprising a locking mechanism for locking said connector housings to one another.

10. The connector assembly of claim 4, wherein said striking member is integral to said spring.

11. A connector assembly, comprising:

a first connector housing including a striking member slidably disposed in a hole provided in said first connector housing and having one end extending obliquely with respect to a longitudinal axis of said hole in a first direction, and a spring interposed between said movable striking member and a portion of said first connector housing for urging said striking member in said first direction; and a second connector housing including a receiver for receiving said one end of said striking member such that said striking member is forced in a second direction, opposite said first direction, upon insertion of one of said connector housings into the other of said connector housings to compress said spring, wherein during engagement of said first and second connector housings, said one end of said striking member is urged toward said longitudinal axis such that said striking member is disengaged from said receiver to cause said striking member to strike against said first connector housing forcing said first connector housing in said first direction.

12. The connector assembly of claim 11, wherein said striking member is integral with said spring.

* * * * *